US007029329B1

(12) United States Patent
Huang

(10) Patent No.: US 7,029,329 B1
(45) Date of Patent: Apr. 18, 2006

(54) TERMINAL BOX

(75) Inventor: Huang-Chou Huang, Taipei (TW)

(73) Assignee: Suyin Corporation, Taipei (TW)

( * ) Notice: Subject to any disclaimer, the term of this patent is extended or adjusted under 35 U.S.C. 154(b) by 0 days.

(21) Appl. No.: 11/023,470

(22) Filed: Dec. 29, 2004

(51) Int. Cl.
*H01R 13/648* (2006.01)

(52) U.S. Cl. ..... 439/607; 439/541.5

(58) Field of Classification Search ..... 439/607–610, 439/654, 440, 105, 107, 606, 76.1, 79, 874, 439/541.5, 83, 630, 90, 170, 222
See application file for complete search history.

(56) References Cited

U.S. PATENT DOCUMENTS 4,313,646 A * 2/1982 Millhimes et al. ..... 439/654
4,460,232 A * 7/1984 Sotolongo ..... 439/535
5,503,565 A * 4/1996 McCoy ..... 439/171
6,264,501 B1 * 7/2001 Hung et al. ..... 439/541.5
6,575,777 B1 * 6/2003 Henriott et al. ..... 439/215
6,736,676 B1 * 5/2004 Zhang et al. ..... 439/607

* cited by examiner

*Primary Examiner*—Gary F. Paumen
*Assistant Examiner*—Edwin A. Leon
(74) *Attorney, Agent, or Firm*—Rosenberg, Klein & Lee

(57) ABSTRACT

A terminal box is mounted inside an electronic machine as a television and is used to connect to multiple terminals for transmission of electronic signals. The terminal box has a housing assembly, a socket assembly mounted inside the housing assembly and multiple prong contacts mounted inside the housing assembly. The socket assembly has multiple socket members interconnecting and each socket member has a socket adapted to be inserted a prong. The terminal box is easily to mount inside the electronic machine and the amount of the socket members of the terminal box is variable for different electronic machines.

8 Claims, 5 Drawing Sheets

TERMINAL BOX

BACKGROUND OF THE INVENTION

1. Field of the Invention

The present invention relates to a terminal, and more particularly to a terminal box that may be mounted inside a machine like a television, a DVD player or an audio recorder and connected to multiple prongs.

2. Description of Related Art

Lots of electronic machines such as televisions, DVD players, audio players and computers are used for work and entertainment. To combine functions of different pieces of electronic equipment, transmitting electronic signals between the pieces of electronic equipment is required. To transmit the electronic signals between the pieces of electronic equipment, each piece of electronic equipment generally has an input and output data terminals. For example, a computer may be connected to an audio recorder by a wire with two terminals respectively at ends of the wire and connected respectively to the input and output terminals of the computer and the audio recorder.

With reference to FIG. 5, a conventional terminal in accordance with the prior art has a casing (50) that has only one socket (51) to connect to a wire by inserting a connector of the wire into the socket (51). For example, when a computer needs to transmit electronic signals to a DVD player and audio player simultaneously, the computer must have at least two conventional terminals to connect two wires respectively from the DVD player and audio player. However, connecting more pieces of electronic equipment to the computer requires that the computer have more conventional terminals. A significant amount of time is required to arrange and install multiple conventional terminals in a piece of electronic equipment, which can be very inconvenient.

To overcome the shortcomings, the present invention provides a terminal box to mitigate or obviate the aforementioned problems.

SUMMARY OF THE INVENTION

The main objective of the invention is to provide a terminal box mounted inside a piece of electronic equipment. The terminal box has a socket assembly having multiple socket members electrically connected to connect the piece of electronic equipment simultaneously to multiple terminals in other pieces of electronic equipment. Therefore, assembling the piece of electronic equipment with the terminal box is easy and quick.

A terminal box in accordance with the present invention comprises a housing assembly, a socket assembly and multiple prong contacts. The socket assembly connects multiple connectors to the terminal box, is mounted inside the housing assembly and has multiple socket members interconnected. The multiple prong contacts are mounted inside the housing assembly.

Other objects, advantages and novel features of the invention will become more apparent from the following detailed description when taken in conjunction with the accompanying drawings.

DETAILED DESCRIPTION OF PREFERRED EMBODIMENT

Figure 1:
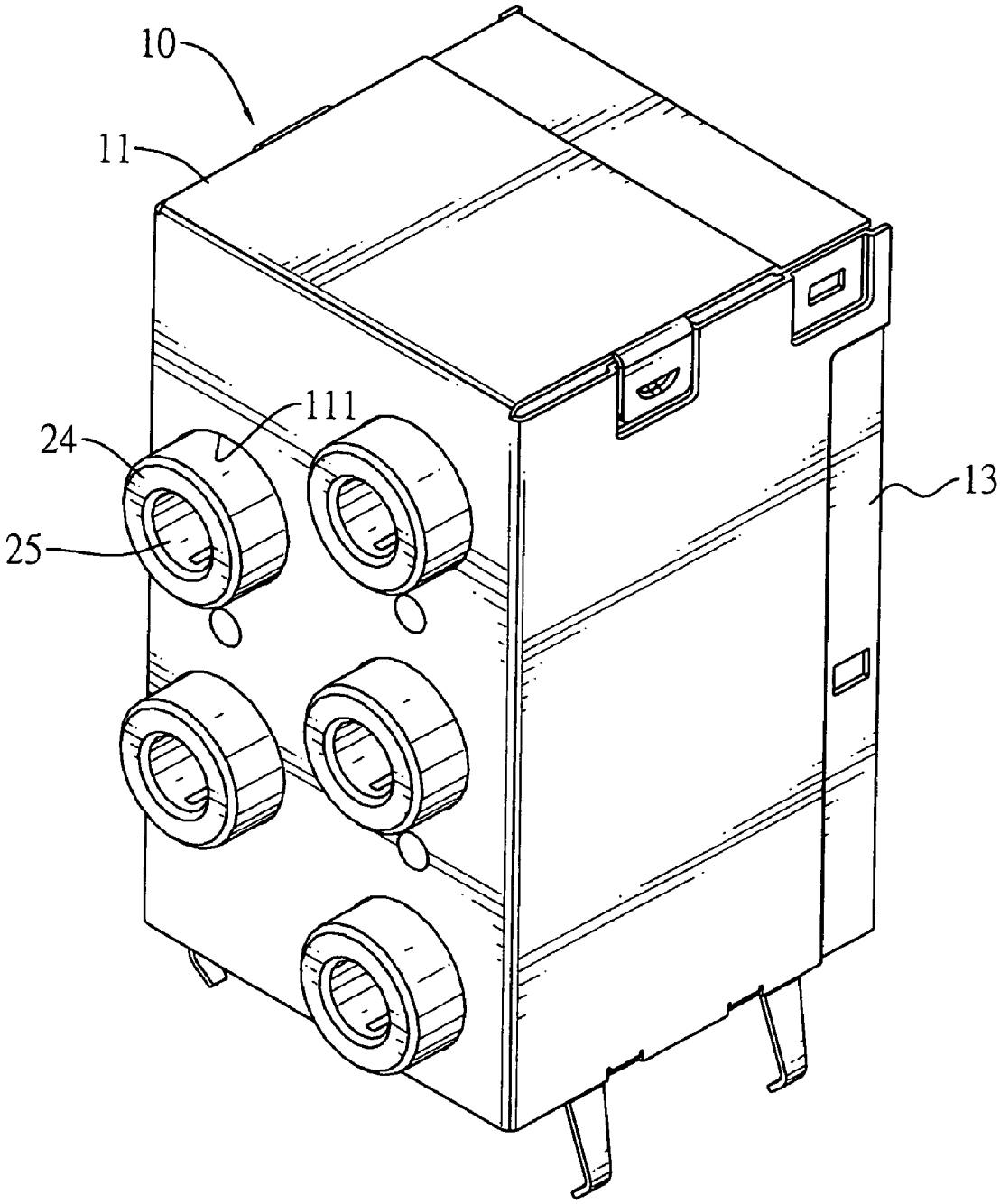
FIG. 1 is a perspective view of a terminal box in accordance with the present invention.
Figure 2:
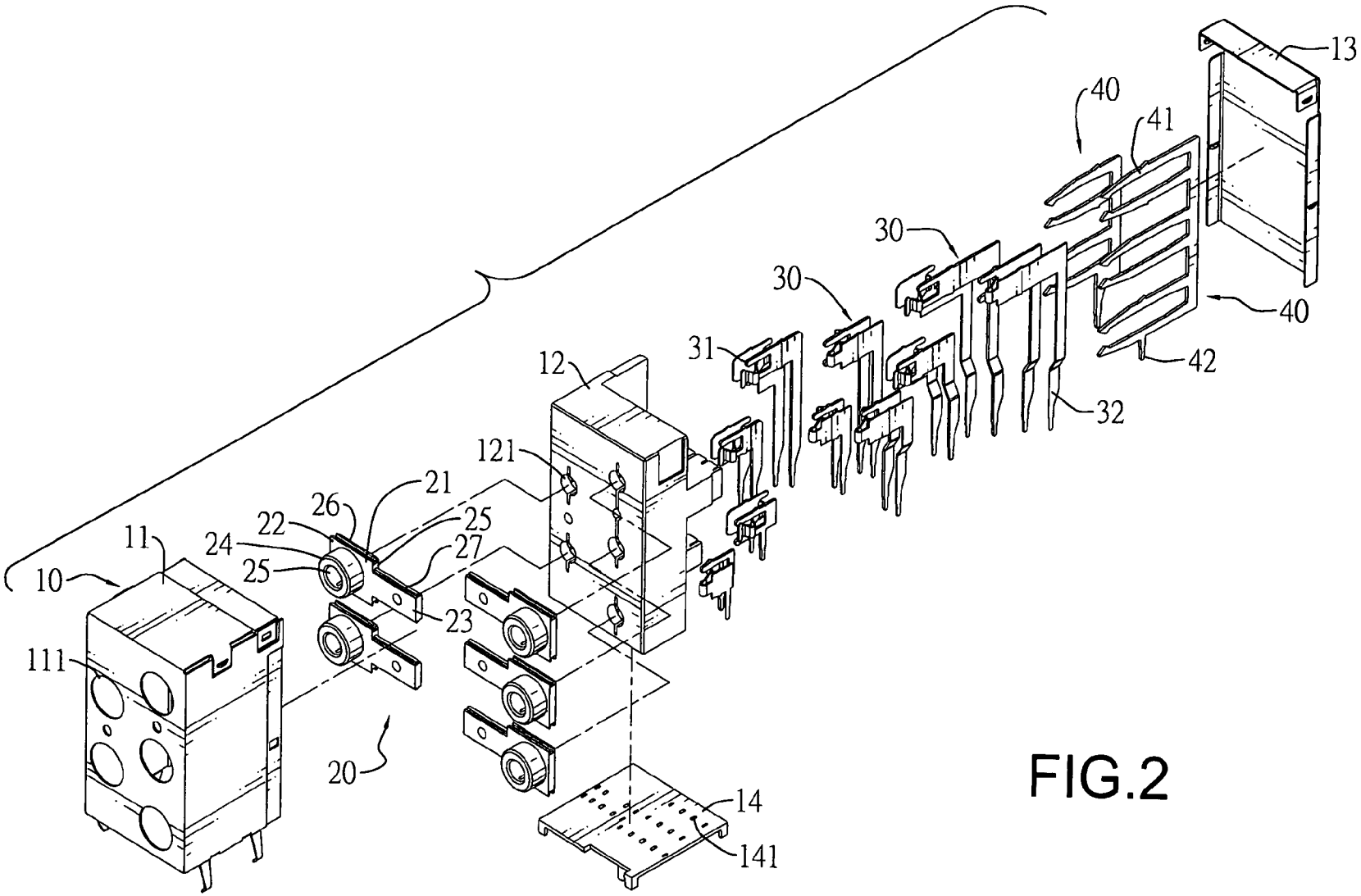
FIG. 2 is an exploded perspective view of the terminal box in FIG. 1.
Figure 3:
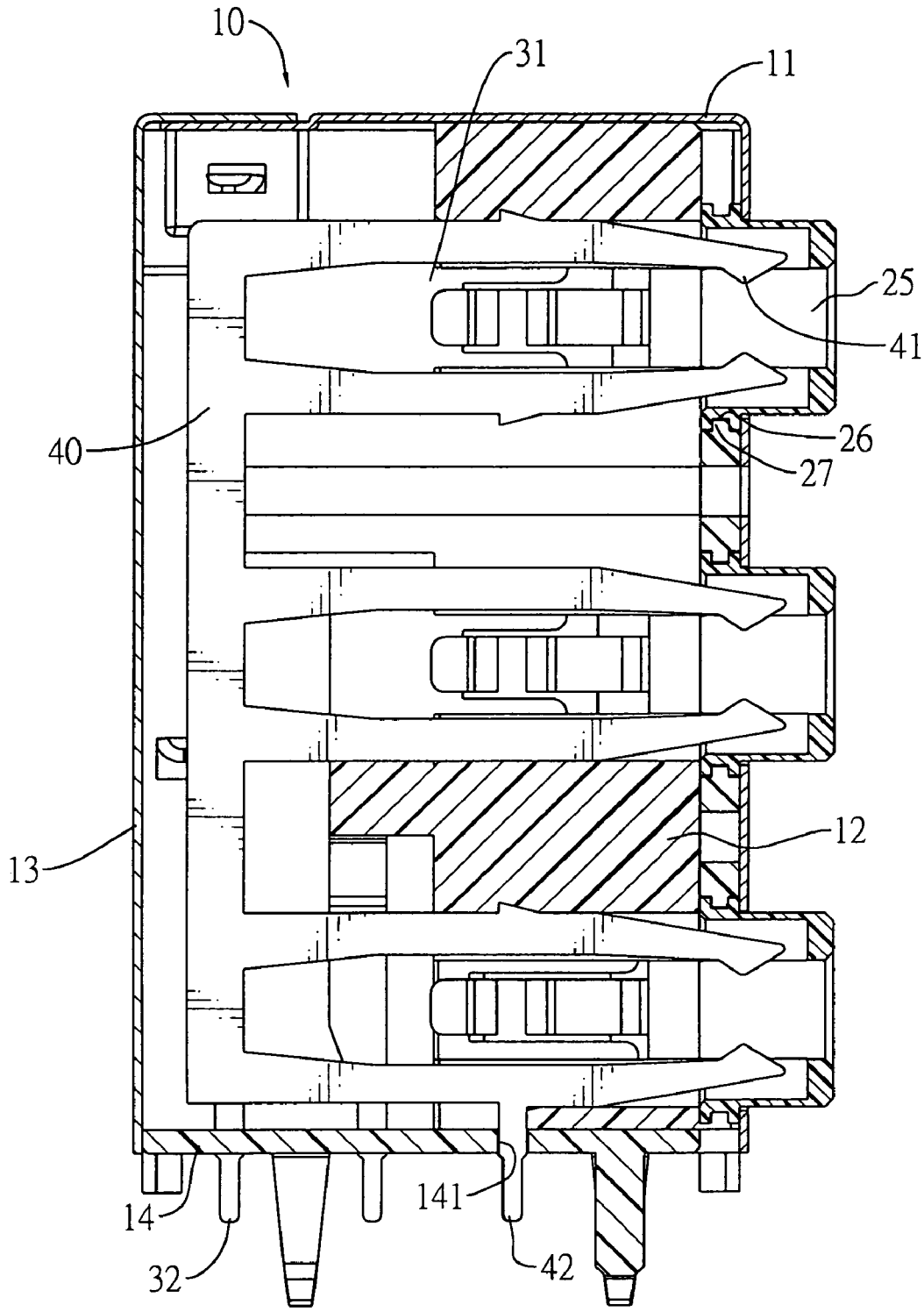
FIG. 3 is a side view in partial section of the terminal box in FIG. 1.
Figure 4:
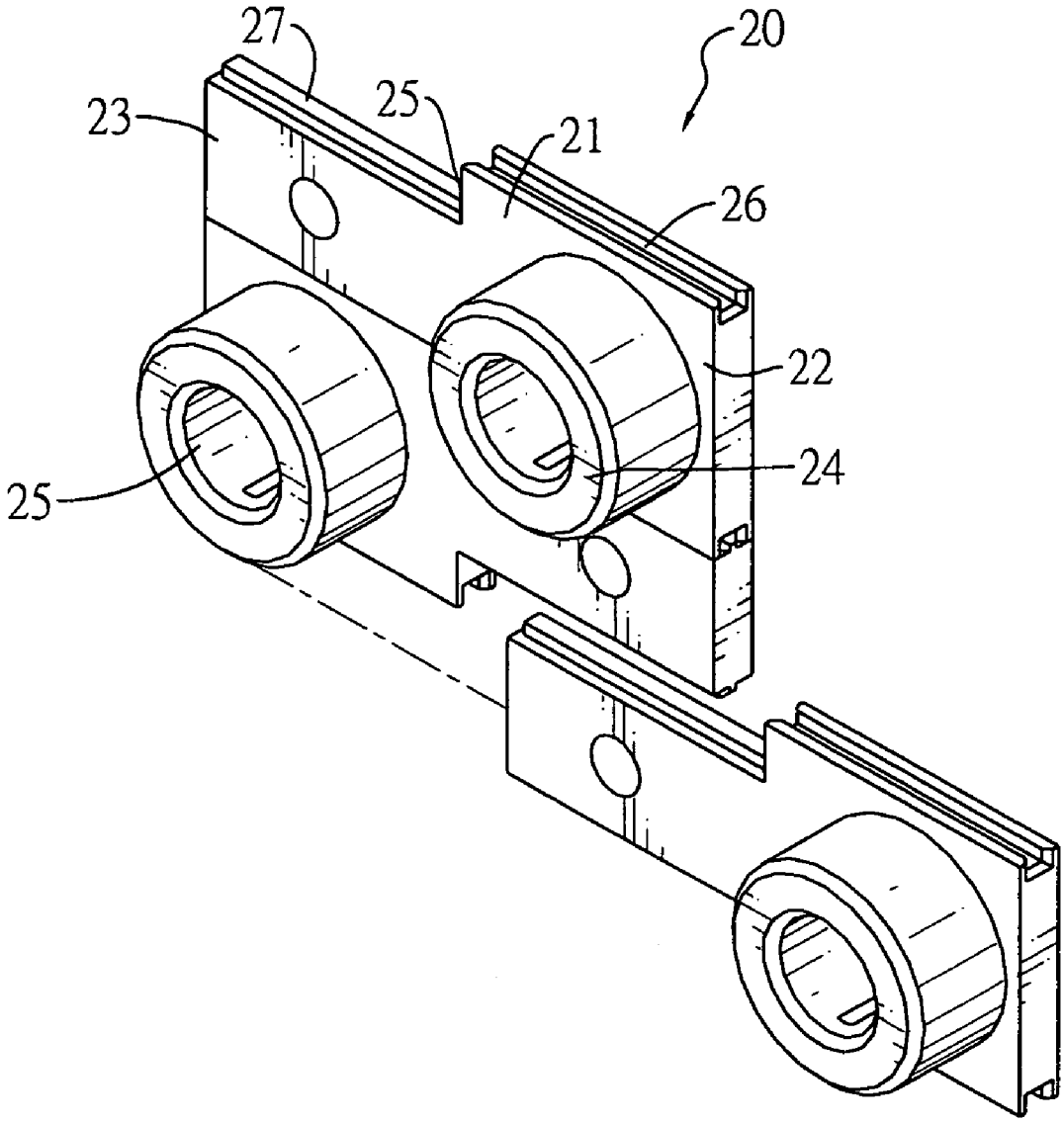
FIG. 4 is an exploded perspective view of a socket assembly in the terminal box in FIG. 1.
Figure 5:
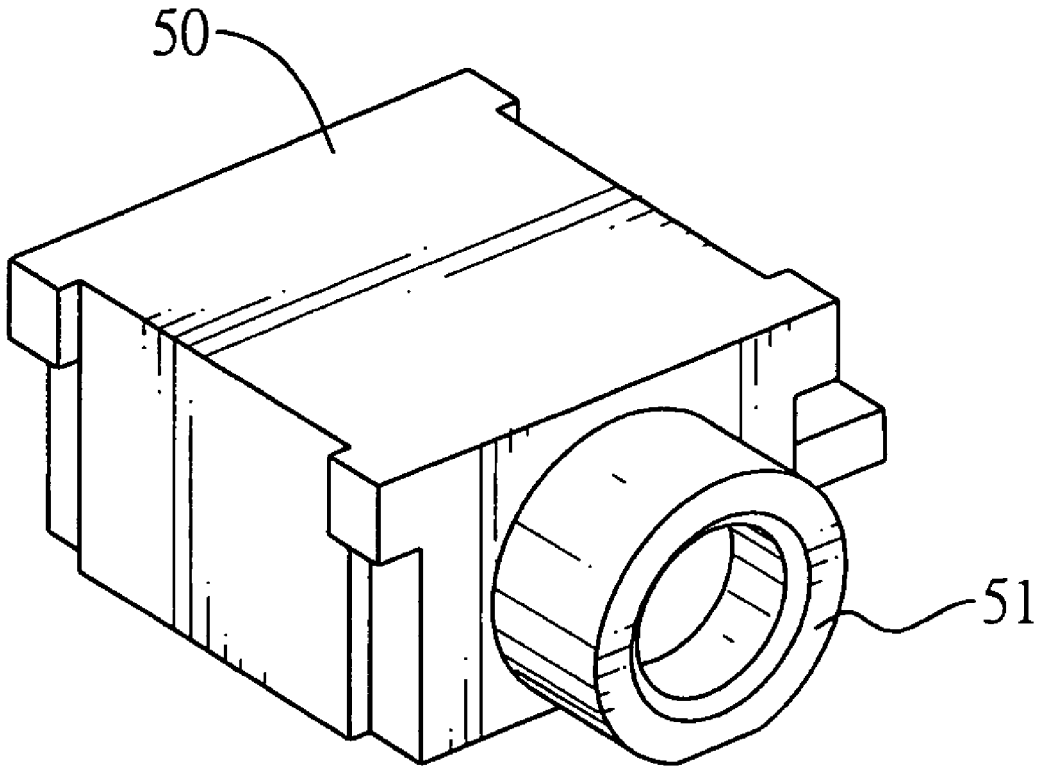
FIG.5 PRIOR ART
FIG. 5 is a perspective view of a conventional terminal in accordance with the prior art.

With reference to FIGS. 1, 2, 3 and 4, a terminal box in accordance with the present invention is mounted inside a electronic piece of electronic equipment like an audio recorder, a television or a DVD player. The terminal box may be connected to other different pieces of electronic equipment so electronic signals can be transmitted between the pieces of electronic equipment. A connector generally has a base (not shown) and a prong (not shown) and is connected to one end of a wire. The base is plastic or other non-conducting material. The prong protrudes from the base and may be metal or metal and insulating material depending on whether the prong is a one-channel or two-channel prong.

The terminal box in accordance with the present invention comprises a housing assembly (10), a socket assembly (20), multiple prong contacts (30) and multiple optional prong clamps (40).

The housing assembly (10) is mounted in a piece of electronic equipment and has a housing (11), a back cover (13), an internal block (12) and an optional housing base (14). The housing (11) has a bottom, a front, a rear a front panel and an open back. The front panel is formed on the front of the housing (11) and multiple through holes (111). The multiple through holes (111) are defined through the front panel. The back cover (13) is mounted over the open back of the housing (11). The internal block (12) is made of non-conducting material, is mounted between the front panel and back cover (13) inside the housing (11), has a front face and multiple prong holes (121) defined through the front face. The housing base (14) is mounted on the bottom of the housing (11) and has multiple mounting holes (141) defined through the housing base (14).

The socket assembly (20) is mounted between the front panel and the internal block (12) inside the housing (11), has multiple socket members (21) engaged together. Each socket member (21) has a selective color for identification of different kinds of electronic signals and has a socket base (22), a flange (24), a socket (25) and a strip (23). The socket base (22) has a proximal end, two edges and two tracks (26). The tracks (26) are defined respectively at the edges of the socket base (22). The flange (24) extends from the socket base (22), corresponds to and passes through one of the through holes (111) of the housing (11). The socket (25) is defined inside the flange (24) through the socket base (22), corresponds to and is aligned with one of the prong holes (121) of the internal block (12). The strip (23) extends from the proximal end of the socket base (22) and has a distal end and two edges. Two protuberances (27) are defined respectively along the edges of the strip (23). The protuberance (27) of the strip (23) corresponds to the track (26) of the socket base (22).

When assembling the two socket members (21), the distal ends of the strips (23) of the socket members (22) are opposite to each other. The protuberance (27) of the first socket member (22) slides into the track (26) of the second socket member (22) and simultaneously the protuberance (23) of the second socket member (22) slides into the track (26) of the first socket member (21). Then the distal ends of the strips (23) are engaged against the corresponding socket bases (22). The way of assembling the socket members (21) is easy and the socket assembly (20) may have a variable amount of the socket members (21) depending on different electronic machines.

The multiple prong contacts (30) are made of metal, adapted to engage respectively with the multiple terminals for electronic signal transmission and mounted between the internal block (12) and back cover (13) inside the housing (11). Each prong contact (30) corresponds to and is aligned with one of the prong holes (121) in the internal block (12). Each prong contact (30) has a receiving end (31) to engage with the prong of the connector and two legs (32). Each receiving end (31) corresponds to and is aligned with one of the prong holes (121) in the internal block (12) and one of the sockets (25) of the socket members (20). Each leg (32) corresponds to and is inserted into one of the mounting holes (141) of the housing base (14).

The prong clamps (40) for clamping the terminal base to prevent the terminal base from falling off are mounted between the internal block (12) and the back cover (13) inside the housing (11). Each prong clamp (40) has couples of clamps (41) and an optional leg (42). Each couple of the clamps (41) corresponds to and passes through one of the prong holes (121) of the internal block (12). The leg (42) of the prong clamp (40) corresponds to and is inserted into the one of the mounting holes (141) of the housing base (14).

When mounting the terminal box of the invention into different electronic machines, a technician may assemble the socket assembly (20) with an amount of the socket members (21) depending on the different electronic machines easily Then the housing assembly (10) with the socket assembly (12) may be mounted conveniently in a preferred position of the electronic machines. The technician needn't worry about how to arrange the multiple terminals in accordance with the prior art inside the electronic machine when the electronic machine needs to connect to multiple terminals.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A terminal box comprising:

a housing assembly having a housing having a front, a rear, a bottom, an open back, a front panel formed on the front of the housing and multiple through holes defined through the front panel;

a back cover mounted over the open back of the housing; and an internal block made of non-conducting material, mounted between the front panel and the back cover inside the housing, and having a front face and multiple prong holes defined through the front face;

a socket assembly mounted between the front panel and the internal block inside the housing, having multiple socket members engaged together, each having a socket base having two edges, a proximal end and two tracks defined respectively at the edges of the socket base;

a flange extending from the socket base, corresponding to and passing through one of the through holes of the housing;

a socket defined inside the flange through the socket base, corresponding to and aligned with one of the prong holes of the internal block; and a strip extending from the proximal end of the socket base, having a distal end, two edges and two protuberances defined along the edges of the strip; and multiple prong contacts made of metal, mounted between the internal block and the back cover inside the housing, and each having a receiving end corresponding to and aligned with one of the prong holes of the internal block and one of the sockets of the socket assembly.

2. The terminal box as claimed in claim 1, the socket members have colors for identification of different kinds of electronic signals.

3. The terminal box as claimed in claim 1 further comprising multiple prong clamps mounted between the internal block and the back cover inside the housing, each having couples of clamps passing respectively through the prong holes of the internal block.

4. The terminal box as claimed in claim 3, the socket members have colors for identification of different kinds of electronic signals.

5. The terminal box as claimed in claim 3, wherein the housing assembly further comprises a housing base mounted on the bottom of the housing and having multiple mounting holes defined through the housing base;

each prong contact further comprises two legs corresponding to and inserted into two of the mounting holes of the housing base; and each prong clamp further comprises a leg corresponding to and inserted into one of the mounting holes of the housing base.

6. The terminal box as claimed in claim 5, the socket members have colors for identification of different kinds of electronic signals.

7. The terminal box as claimed in claim 1, wherein the housing assembly further comprises a housing base mounted on the bottom of the housing and having multiple mounting holes defined through the housing base; and each prong contact further comprises two legs corresponding to and inserted into two of the mounting holes in the housing base.

8. The terminal box as claimed in claim 7, the socket members have colors for identification of different kinds of electronic signals.

* * * * *